United States Patent [19]

Shaughnessy

[11] 4,173,162

[45] Nov. 6, 1979

[54] PNEUMATICALLY BRAKED BLADE ASSEMBLY FOR A CLIPPER MACHINE

[76] Inventor: Ernest P. Shaughnessy, Rte. 1, Box 474, Portland, Oreg. 97231

[21] Appl. No.: 869,650

[22] Filed: Jan. 16, 1978

Related U.S. Application Data

[63] Continuation-in-part of Ser. No. 717,200, Aug. 24, 1976, abandoned.

[51] Int. Cl.[2] ..... B26D 5/12; B27L 5/08

[52] U.S. Cl. ..... 83/617; 83/630; 83/639; 91/394

[58] Field of Search ..... 83/639, 630, 617; 91/394, 404, 452

[56] References Cited

U.S. PATENT DOCUMENTS

| | | | |
|---|---|---|---|
| 3,691,902 | 9/1972 | Lebzelter | 91/394 |
| 3,837,250 | 9/1974 | Lumn | 83/639 |
| 3,889,576 | 6/1975 | Sheffer et al. | 91/394 |
| 3,894,460 | 7/1975 | Lumn | 83/639 |
| 4,130,041 | 12/1978 | McGee | 83/617 |

*Primary Examiner*—Donald R. Schran
*Attorney, Agent, or Firm*—James D. Givnan, Jr.

[57] ABSTRACT

A machine for clipping strip material including a blade operated in a cyclic manner having a cutting stroke and a return stroke. A toggle linkage including a toggle bar effecting one blade cycle by moving in a lengthwise direction with the blade being reciprocated by toggle linkages moving through an upright position to a position oppositely inclined to their starting position. The toggle bar is coupled to an actuating piston rod of a pneumatic cylinder. End caps of the cylinder are recessed to receive piston extensions during final stages of piston travel for cushioning purposes. Seal means engage each piston extension during the later stage of piston travel to trap air between the advancing piston and the end cap. Accordingly, blade and toggle assembly inertia is dissipated in the compression of trapped cylinder air. Exhaust means within each of said end caps is valve controlled to release cylinder pressure at a desired pressure braking the latter stages of piston travel. A modified form of cylinder includes modified exhaust poppet valves each subject to a valve regulated, poppet closing pressure as in the first form of cylinder and additionally having a surface area thereon against which a secondary source of air may act to hold the poppet closed against extremely high piston actuating pressures. The modified cylinder further includes end caps each having a port served by an end cap mounted valve to admit a piston actuating charge and a remaining port admitting a secondary flow into the cylinder and controlled by an end cap mounted valve.

17 Claims, 3 Drawing Figures

PNEUMATICALLY BRAKED BLADE ASSEMBLY FOR A CLIPPER MACHINE

BACKGROUND OF THE INVENTION

The present application is a continuation-in-part of my copending U.S. patent application bearing the same title and filed Aug. 24, 1976 under Ser. No. 717,200 now abandoned.

The present invention relates generally to clipping machines and particularly to such a machine having a pneumatically powered blade with the pneumatic component also providing braking means for the blade.

In clipping machines, such as those used to clip lengths of wood veneer ribbon into sections for laminating into plywood, a blade is intermittently reciprocated. Such blades and their supporting linkage move at great speed during the cutting stroke with considerable momentum resulting in a blade rebound problem. Substantial inertia is developed during blade and linkage movement which must be dissipated to avoid such rebound. Ideally, blade inertia would be dissipated immediately prior to or at the blade returning to its raised, static position. Blade rebound is undesirable for the reason that precise cutting of the veneer material is adversely affected. The cycling time of a rebounding blade versus that of a static blade at rest will vary in milliseconds by reason of the rebounding blade being out of position at the start of the cutting stroke which stroke will hence be of an indefinite length. As clipper blades are commonly operated in conjunction with electronic ribbon scanning systems and high linear ribbon speeds it is essential that clips be made at high blade speeds and be precise for avoidance of waste. Presently, clipper blade speed is the pacing factor in veneer production.

SUMMARY OF THE INVENTION

The present invention is embodied within a clipper blade and its supporting linkage with pressure responsive means in the form of an air cylinder wherein the cylinder accomplishes both blade actuation and braking of cylinder associated components to a non-rebounding stop.

The present assembly includes a base attachable to the frame of a clipper machine which may be incorporated as a modification thereto. Suspended from said base is a toggle linkage attached to an intermediate toggle bar adapted for linear motion during a cutting cycle. A blade assembly is carried by the toggles and accordingly is driven through one cycle of operation by uni-directional movement of said toggle bar past a dead center position. The air cylinder is disposed on said base so as to impart lengthwise movement to the toggle bar with a cutting stroke being completed with movement of the toggle bar from a retracted to an extended position and conversely, a second cycle is completed by subsequent, opposite travel of the toggle bar. During one cutting cycle the blade edge is driven through the clipped wood material supported on an anvil which normally is of cylindrical configuration and of a resilient nature. The air cylinder means may be generally described as a double rod, double acting type. Included within said cylinder means is a valve arrangement to dissipate blade linkage inertia to avoid blade rebound from an uppermost position of rest. Said valve arrangement is biased by a regulated medium to permit unseating and cylinder exhausting at a selected pressure value.

Present objectives off the instant invention include the provision of; a pneumatic cylinder particularly adapted for driving the blade of a clipping machine at high speed while also braking same to avoid substantially all blade rebound and impact loads on related components; a pneumatic cylinder for use with a blade assembly wherein cylces of operation may be in rapid sequence without blade rebound and consequent imprecise clipping of strip material; a pneumatic cylinder incorporating cushioning means dissipating cylinder and blade assembly inertia at a substantially constant rate prior to the completion of a blade cycle; a pneumatic cylinder having poppet valve members biased by a regulatable fluid operable to exhaust the cylinder in a controlled manner ahead of a piston to preclude piston impact; a clipping blade assembly including a power source having a unitary nature for installation on existing clipping machines; a pneumatic cylinder having end caps adapted to mount flow controlling valves to minimize conduit volume between valves and piston to thereby reduce response time between valve actuation and piston movement for more precise clipper blade control; a pneumatic cylinder having a two-way valve thereon admitting a piston actuating charge in a direction normal to the piston surfaces; a pneumatic cylinder having a valve controlled secondary pressure flow supplementing the above mentioned normally directed pressure flow; a pneumatic cylinder having a poppet valve in each end cap jointly biased to a closed position by a constant, regulatable fluid pressure and by an intermittent fluid pressure bled off from the cylinder interior whereby the poppet valve is held closed in the presence of very high piston actuating pressures which heretofore would unseat the poppet valve resulting in diminished piston speeds; a pneumatic cylinder that does not utilize troublesome seals or ball check valves (most often the cause of cylinder failure) and hence a cylinder compatible with much greater cylinder operating pressures for greater clipper blade cycling speed with the added benefit of decreased cylinder maintenance.

BRIEF DESCRIPTION OF THE DRAWINGS

In the accompanying drawings.

DESCRIPTION OF THE PREFERRED EMBODIMENT

Figure 1:
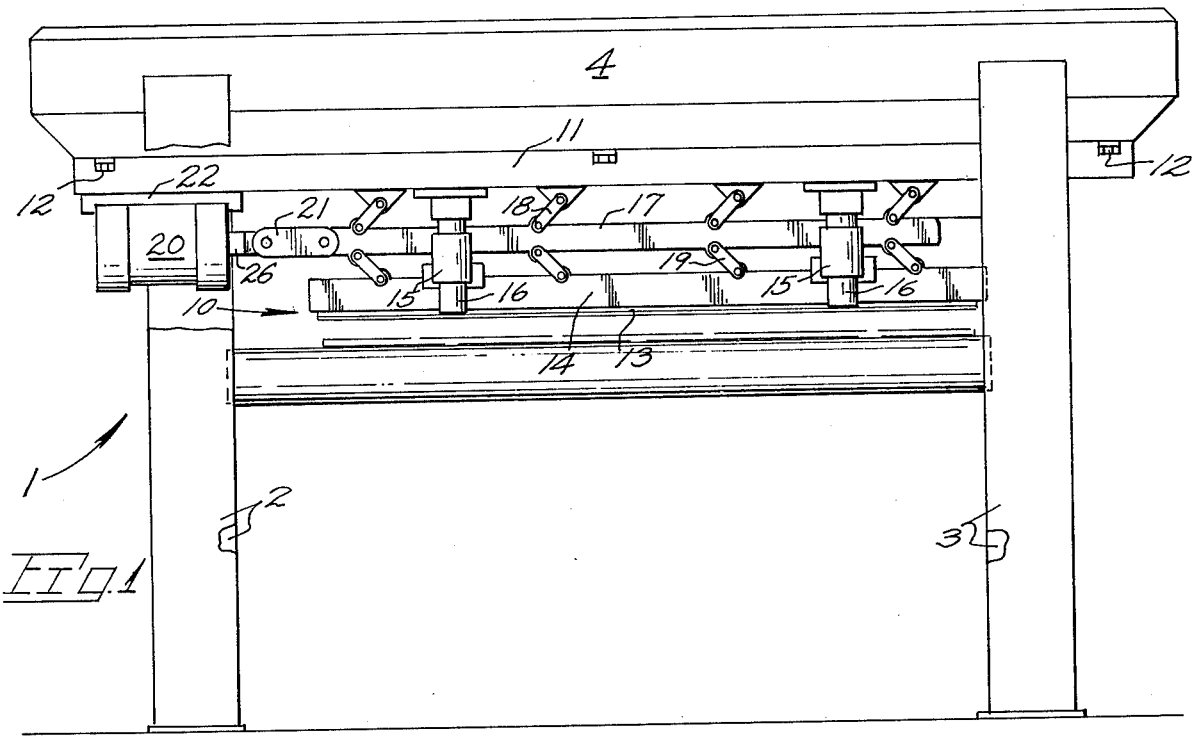
FIG. 1 is a front elevational view of a machine for clipping elongate material into sections.

With continuing reference to the accompanying drawings wherein applied reference numerals indicate part similarly identified in the following specification, the reference numeral 10 indicates generally a machine hereinafter termed a clipper of the type commonly used for severing bands of peeled wood veneer commonly used in the layup of plywood. Such clipper conventionally include pairs of leg members 2 and 3 supporting at their upper ends a machine base 4 all of welded plate construction. Indicated generally at 10 is a blade assembly including an elongate member 11 suitably secured to the underside of base 4. One form of such securement may be by means of bolt members 12 which permit detachable installation of member 11 to machine base 4. A clipper blade 13 is detachably mounted on a blade bar 14 which bar also is provided with cylindrical guides 15. Posts at 16 depend from elongate member 11 to guide the blade bar and assure vertical reciprocal movement of blade 13 during each cycle of operation.

A toggle assembly includes a toggle bar 17 which pivotally mounts the opposing ends of upper and lower sets of toggle links 18 and 19 connected at their outer ends respectively to member 11 and blade bar 14. Passage of the links to an oppositely inclined position upon lengthwise displacement of toggle bar 17 in one direction will cause blade 13 to be moved downwardly through a cutting stroke and thence upwardly through a return stroke constituting one cycle of blade operation. The blade and its supporting guide means is not unlike that general arrangement found on existing clipping machines.

Driving blade 13 in a cyclic manner is a pneumatic cylinder 20 which is in end mounted relationship to toggle bar 17 and connected thereto by a pivotally mounted linkage 21. Cylinder 20 is mounted on member 11 by means of a bracket 22. In existing clippers, end mounted cylinders for actuating toggle linkage and a cutter blade supported thereby are common, however such cylinders are not believed to embody means for dampening blade rebound.

Figure 2:
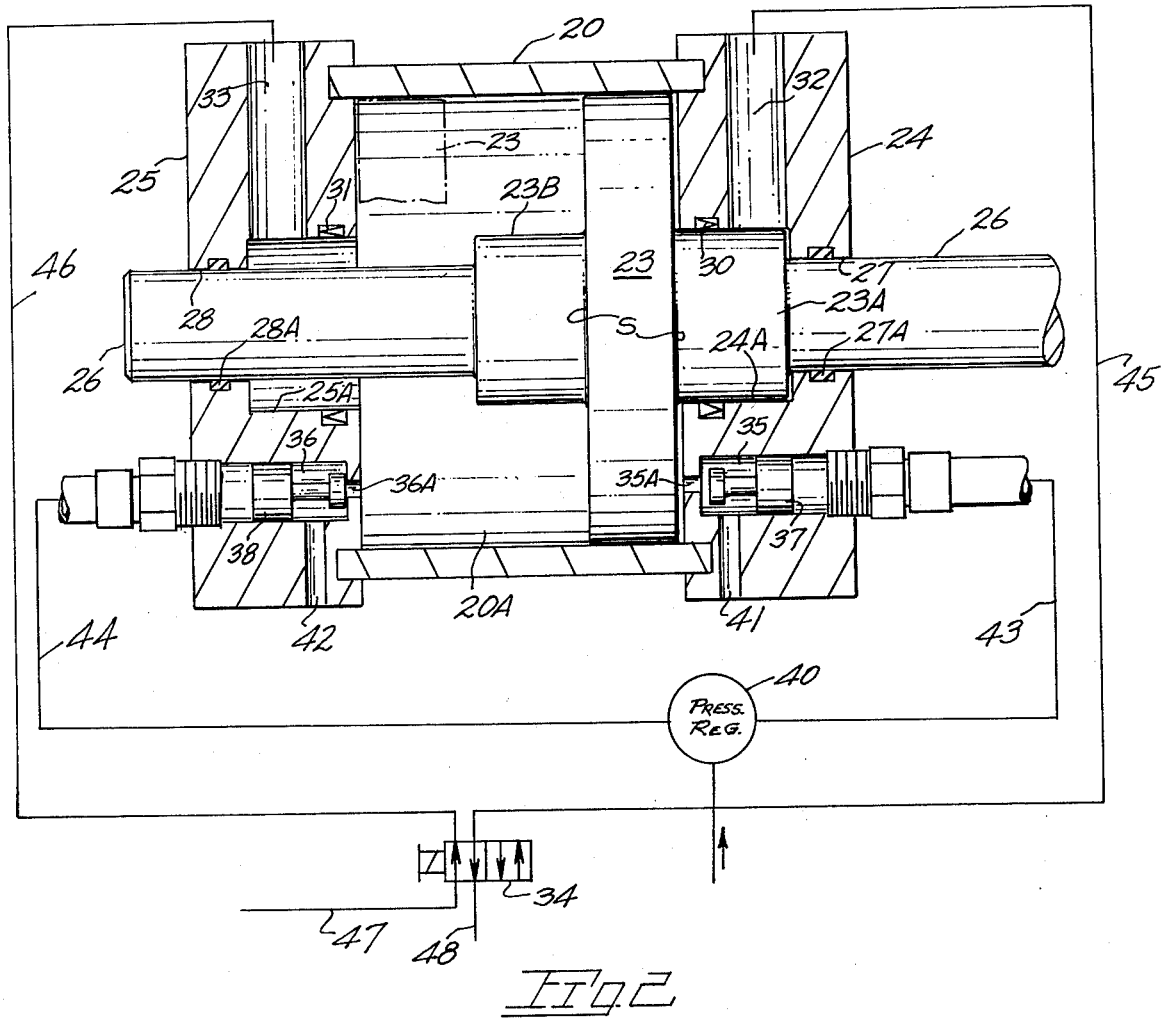
FIG. 2 is a sectional view of a pneumatic cylinder comprising part of the present blade assembly.

With attention now to FIG. 2, the pneumatic cylinder 20 is of the double rod, double acting type with equal displacement from a chamber 20A on both sides of a piston 23. Piston surfaces are indicated at S. Cylinder 20 is closed by end caps 24, 25 each centrally recessed at 24A, 25A to receive oppositely directed piston extensions 23A and 23B. A piston rod 26 is slidably journalled and sealed at 27A, 28A within aligned openings at 27 and 28 in the end caps. Uni-directional seal means at 30 and 31 in end caps 24 and 25 sealingly engage the piston extensions to prevent the subsequent escapement of air compressed by an advancing surface S of piston 23. Serving each end of cylinder 20 are end cap bores 32 and 33 with airflow therethrough being controlled by a four way, two position valve 34 permitting either end of the cylinder to be pressurized and the opposite end vented via lines 45,46. The seal means at 30 and 31 permit air entry into cylinder chamber 20A in one direction to actuate piston 23 but prevent escaping airflow in an opposite direction for the purpose of sealing chamber 20A once a piston extension (23A,23B) has engaged its respective seal.

Valve 34 is in communication with a source of air pressure via a line 47 and vented to the atmosphere at 48. In most installations valve 34 will be solenoid actuated in circuit with an electronic scanning system initiating cutting strokes at desired intervals and to clip out waste ribbon material.

Each end cap embodies exhaust means including bores at 35 and 36 in communication with cylinder chamber 20A via ports 35A, 36A each normally closed by biased valve members 37, 38 shown as poppet valves. Bores 35, 36 are in communication, via pressure regulating means at 40, with a pressure source whereby the valves are biased to closed positions to close off their respective ports 35A, 36A. A pair of vents at 41, 42 exhaust to the atmosphere. Air lines at 43, 44 communicate air under the desired pressure through suitable fittings into each bore 35, 36 to bias valve members 37, 38 closed. While shown as being air biased, mechanical biasing means could be utilized.

In operation, one cycle of blade operation will take place as piston 23 moves from one extreme to the other. The cut or clipping action occurs as toggle bar 17 is displaced lengthwise imparting vertical motion to the blade 13 by the over center travel of toggle links 18 and 19. For example, pressurized air entering bore 32 will travel past uni-directional seal means 30 to actuate piston 23 to the left (in FIG. 2). Midway in its travel along cylinder 20, piston extension 23B comes into sealing contact with unidirectional seal 31 to thereafter close chamber 20A ahead of the moving piston surface. Such closure takes place as blade 13 commences its return travel to its rest position. The remaining travel of piston 23 is resisted by increasing pressurization of that portion of chamber 20A ahead of said piston surface. The dynamic energy of the piston, toggle linkage, blade and blade holder is dissipated by compression with energy being converted into heating of the air compressed ahead of advancing piston 23. Valve 38 will unseat at a desired pressure value within cylinder 20A to permit piston 23 to come to rest in the broken line position of FIG. 2 in a "cushioned" manner thus avoiding blade rebound.

While cylinder 20 is shown and described in combination with the blade of a veneer clipping machine, such is not intended to imply use of such, or the later described cylinder, is limited to such combination.

Figure 3:
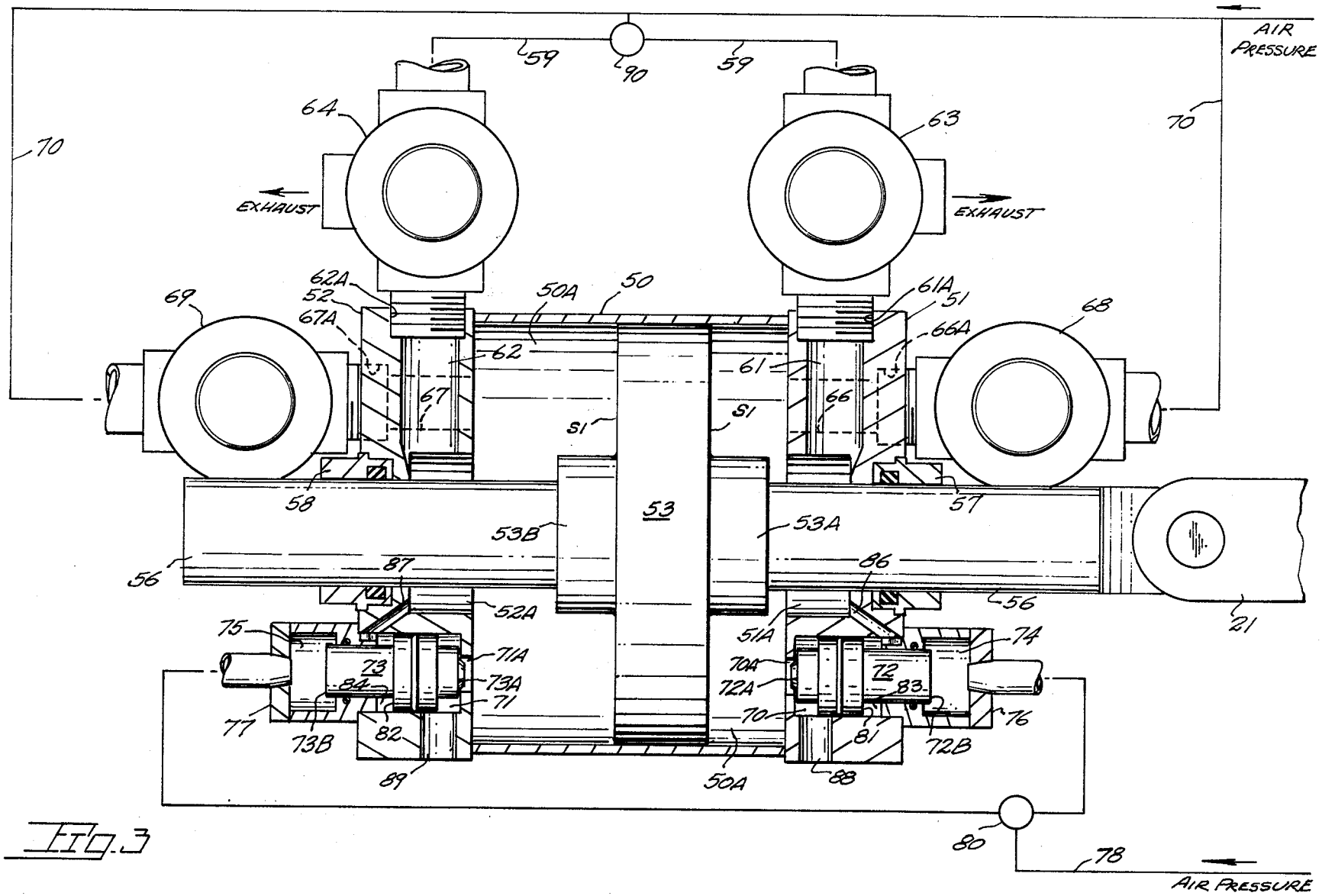
FIG. 3 is a view similar to FIG. 2 but showing a modified cylinder.

A modified form of cylinder is indicated at 50 in FIG. 3 and, in similarity to the first form of cylinder shown in FIG. 2, includes end caps 51–52 with the cylinder being of the double acting, double rod type with equal displacement from a chamber 50A on both sides of a piston 53 having piston surfaces S1. The end caps 51–52 are centrally recessed at 51A–52A and receive in surfacial sealing engagement (without seals) oppositely directed axial piston extensions 53A–53B coaxial with a piston rod 56. Said rod is slidably journalled in each end cap by rod seal equipped bushings 57–58 and terminates in attachment to linkage 21 coupling a work performing instrumentality.

Attention is directed to the absence of air seals in the end caps for intermittent sealing engagement with piston components. The dispensing with of short lived air seals avoids operating pressure limitations and the most common cause of cylinder malfunction i.e., seal damage or wear and consequent blow by with loss of the cylinder's inertia absorbing capability. The present cylinder extensions 53A–53B are substantially net in fit to provide airtight, surfacial sealing engagement with the end cap recesses 51A–52A.

Each end cap 51–52 defines a first port 61–62 terminating in inward communication with end cap recesses 51A–52A. A three way solenoid actuated valve at 63–64 is mounted within a threaded segment 61A–62A of each port and functions to alternately control the entry of a supplemental airflow into the cylinder end and to exhaust the opposite cylinder end. Air lines 59 serve said valves.

Each end cap additionally defines a second port 66–67 extending through the cap and directing a pressurized piston stroking air charge or flow in a direction normal to piston surfaces S1. Each end cap is adapted, as by a threaded segment 66A–67A of ports 66–67, to mount a two way valve 68–69 served by a branched air line 70. Mounting of valves 68–69 on end caps 51–52 in close proximity with the cylinder piston virtually eliminates the communicating volume between valve and piston to provide substantially instantaneous movement of piston 53 upon valve (68 or 69) actuation during a firing stroke. An economy is also effected in the reduced use of compressed air from a plant compressor.

Valves 63-64 and 68-69 are preferably solenoid actuated, the same having an armature in circuit with an electronic scanning system which monitors the moving veneer ribbon and triggers the valves at one side of the cylinder to drive the piston and clipper blade linkage 21. Other applications of the present cylinder, of course, would include various signal generating sources other than an electronic scanning system.

Each end cap 51-52 embodies cylinder exhaust means housed in end cap bores 70-71 ported at 70A-71A to the cylinder interior. Poppet valves 72-73 each include a valve face 72A-73A which may seat against ports 70A-71A to close same. Said poppet valves also include a primary pilot air biased end surface 72B-73B responsive to pilot air pressure in chambers 74-75 within suitably attached end cap fittings 76-77. A primary pilot pressure line 78 is branched at a pressure regulator 80 to permit convenient, uniform adjustment of primary pilot pressure acting on both poppet valves. The poppet valves, end cap bores 70-71 and attached fittings are suitably sealed to prevent leakage.

A secondary air biased surface 81-82 on each poppet valve is of annular shape and is responsive to air pressures within end cap chambers at 83-84 which, in turn, are in respective communication with end cap central recesses 51A-52A via air passageways 86-87. Pressures applied to surface 81-82 supplement pilot air pressure to retain the poppet seated against all cylinder stroking pressures. The cylinder exhaust means additionally include vents at 88-89 which serve, upon poppet valve opening, to exhaust a nonconstant, uniform pressure flow from the cylinder interior.

In a typical uni-directional stroke of piston 53 and one full cycle of clipper blade operation, pressurized air is admitted, for example, via signal actuated valve 68 while valve 64 at the cylinder's opposite end is simultaneously actuated to an exhaust position venting the cylinder interior to the atmosphere. Valve 63 is actuated simultaneously with valve 68 to contribute to piston stroking pressurization within one end of the cylinder. Air pressure flow from valve 63 via port 61, end cap recess 51A, passageway 86 and chamber 83 biases poppet valve 72 to hold same closed against port 70A and the piston stroking pressure in the cylinder. The biasing air pressure being applied to poppet secondary air biased poppet surface 81 supplements the poppet closing force exerted by primary pilot pressure in chamber 74.

Desirably the valves 68-69 are solenoid actuated valves permitting the valve control circuit to include a timing component for "Pulsed" or timed valve opening for a portion of the piston stroke to avoid excessive residual pressurization of the cylinder interior and consequent impedance of the next or return stroke of the piston. With attention back to a typical stroke sequence of piston 53, two way valve 69 at one end of the cylinder is closed throughout the stroke while valve 64 remains in a vent or exhaust position throughout the stroke to vent the cylinder interior. The cutting action of the clipper blade occurs at the mid-point of piston travel with piston travel being thereafter cushioned as piston extension 53B sealingly engages the end cap shoulder defining end cap recess 52A thereby sealing the cylinder interior ahead of advancing piston 53. Subsequent cylinder pressurization serves to dissipate the dynamic energy of piston 53 and any driven component such as the clipper blade now on its return or upward half of a blade cutting cycle. Poppet valve 73 remains seated against port 71A in response to primary pilot pressure in chamber 75. Cylinder pressure buildup eventually unseats poppet 73 with cylinder pressure above a certain value thereafter venting via vent 89. During such cushioning of the piston, the secondary biasing surface 82 is inoperative as chamber 84 is vented, via passageway 87, central end cap recess 52A and valve 64, to the atmosphere.

For retaining the piston 53 against end cap 52 and hence the clipper blade at a raised rest position, valve 63 in the present example, remains open to communicate a somewhat reduced pressure to the cylinder interior. A regulator 90 in air line 59 may be used in such instances.

In one suitable embodiment of the cylinder, piston diameter is approximately twenty-five centimeters with a stroke of twelve point five centimeters. Cylinder stroking pressure, admitted by oppositely acting two way valves 68-69 may for example be 115 psi while a somewhat reduced pressure 30 psi is admitted via three way valves 63-64. Primary pilot surfaces 72B-73B receive a continuous poppet valve closing force of 43 pounds with opening and controlled venting of cylinder ends occurring upon piston cushioning pressure applying a somewhat greater force against poppet valve faces 72A-73A to unseat same and vent a non-constant cylinder discharge. Such discharge dissipates piston speed and constitutes a "cushioning" action for the piston and associated work instrumentalities.

To retain the poppet valves seated in the presence of piston actuating or stroking pressures, the intermittently applied biasing force, applied against poppet valve surfaces 81-82, is approximately 47 pounds which, of course, is additional to the primary pilot biasing force of 43 pounds. Both air pressure and component surface areas may of course vary to best suit each cylinder use.

It is to be understood that the cylinder end cap arrangement including the two way and three way valves thereon, the end cap multiple porting and the surfacial sealing engagement of the piston extensions with the end caps may all be somewhat less advantageously utilized in a cylinder having exhaust means other than the poppet valve type presently disclosed.

While I have shown but a few embodiments of the invention it will be apparent to those skilled in the art that the invention may be embodied still otherwise without departing from the spirit and scope of the invention.

Having thus described the invention what is desired to be secured under a Letters Patent is:

1. In combination with a toggle assembly of a clipping machine, a reciprocally cyclical blade carried by said assembly with a cutting stroke and a return stroke coincident with lengthwise movement of a toggle bar and passage of toggle linkages through an upright position, the improvement comprising, a pneumatic cylinder of the double acting type imparting lengthwise movement to the toggle bar of the toggle assembly causing one reciprocal cycle of blade operation, a piston within said cylinder having axial extensions of reduced diameter, a piston rod, and end caps closing the cylinder and each defining a central recess to alternatively receive said piston extensions, each end cap recess in communication with a valve controlled pressurized source of air for alternately powering the piston, and cylinder exhaust means within each of said end caps, said exhaust means including pressurized air biased valve members alternately opening to vent a non-constant flow of air from ahead of the moving piston from the cylinder interior at a predetermined cylinder pressure value the build up of which pressure dissipating blade and toggle assembly inertia to prevent blade rebound from a blade rest position.

2. The invention claimed in claim 1 wherein said biased valve members are in communication with a common pressure regulating means.

3. The invention claimed in claim 2 wherein said biased valve members are in the form of poppet valves.

4. The invention claimed in claim 1 wherein engagement of a piston extension with an end cap occurs contemporaneously with the completion of the downward cutting stroke of the blade with subsequent cylinder pressurization ahead of the piston occurring during the return upward stroke of the blade.

5. A pneumatic cylinder of the double acting type comprising in combination, a piston within said cylinder having axial extensions of reduced diameter, a piston rod, end caps closing the cylinder and each defining a central recess to alternately receive said piston extensions, each end cap recess in communication with a valve controlled pressurized source of air, and cylinder exhaust means carried by each of said end caps and including pressurized air biased valve members alternately operable to vent a non-constant flow of air from ahead of the moving piston from the cylinder interior at a pre-determined pressure value to dissipate piston speed.

6. The invention claimed in claim 5 wherein said biased valve members are in communication with a common pressure regulating means.

7. The invention claimed in claim 6 wherein said biased valve members are in the form of poppet valves.

8. The invention claimed in claim 5 wherein said air biased valve members are poppet valves slidably housed one each in an end cap, each poppet valve subject to a primary pilot pressure biasing the poppet valve toward a cylinder closing position, each poppet valve also intermittently subject to a supplementary poppet valve closing pressure assuring poppet valve closure in the presence of piston actuating air pressures.

9. The invention claimed in claim 8 wherein said end caps each define an air passageway communicating the central recess of the end cap with the end cap housed poppet valve, each poppet valve having a secondary air biased surface against which said supplementary poppet valve closing pressure acts.

10. A pneumatic cylinder of the double acting type comprising in combination, a piston within said cylinder and having axial extensions of reduced diameter, a piston rod adapted at one end for linking to a work performing instrumentality, end caps of the cylinder each defining a central recess to alternately receive said piston extensions, each end cap also defining a first port communicating the cap central recess with a first air valve, each end cap also defining a second port communicating a second valve with the cylinder interior, said second port in each cap intermittently directing a charge of piston actuating air against a piston surface, said first port in each end cap serves to exhaust cylinder air from ahead of an advancing piston until a axial extension sealingly engages an end cap and alternately serves to admit pressurized air to the cylinder behind an advancing piston, and cylinder exhaust means carried by each of said end caps, each exhaust means including a pressurized air biased valve member independently opening to vent a non-constant flow of cylinder air trapped ahead of the advancing piston by sealing engagement of a piston extension with an end cap, cylinder venting by said biased valve members occurring at a predetermined cylinder pressure and serving to dissipate piston and work instrumentality inertia and hence rebound tendencies of same.

11. The pneumatic cylinder claimed in claim 10 wherein said end caps are each adapted to support one of said second air valves whereby the volume of air between each of said second valves and the cylinder interior is minimized to reduce piston response time to a valve controlled air flow.

12. The pneumatic cylinder claimed in claim 11 wherein each of said end caps is further adapted to support one of said first air valves.

13. The pneumatic cylinder claimed in claim 10 wherein each of said air biased valve members are poppet valves one each carried by an end cap, each poppet valve subject to a primary pilot pressure biasing the poppet valve toward a cylinder closing position and intermittently subject to a supplementary valve closing pressure assuring poppet valve closure in the presence of piston actuating air pressure.

14. The pneumatic cylinder claimed in claim 13 wherein said end caps each define an air passageway communicating the central recess of the end cap with the end cap housed poppet valve, each poppet valve having a secondary air biased surface against which said supplementary pressure acts.

15. In a pneumatic cylinder of the double acting type having a piston and piston rod for coupling to a work performing instrumentality, said cylinder including exhaust means responsive to internal cylinder pressures for venting the cylinder chamber air above a pre-determined pressure, the improvement comprising, a piston having axial extensions, end caps closing the cylinder ends and each defining a central recess within which a piston extension is slidably received in surfacial sealing engagement to close the cylinder chamber, said end caps each defining multiple ports, one of said ports in each end cap extending through the end cap and serving to admit a valve controlled flow of piston stroking pressurized air for direct impingement against a piston surface, a remaining port in each end cap terminating in communication with said central recess of the cylinder and serving to admit a valve controlled flow of pressurized air to said cylinder behind the moving piston, said remaining port in each end cap additionally serving to communicate that portion of the cylinder chamber ahead of the moving piston with a cylinder exhaust until a piston extension sealingly engages an end cap whereafter the build up of cylinder pressure dissipates piston momentum.

16. The improvement claimed in claim 15 additionally including a valve on each of said end caps controlling the admission of pressurized air through said one of said ports in each end cap.

17. The improvement claimed in claim 16 additionally including a valve on each of said end caps controlling the flow of pressurized air through said remaining port in each cap.

* * * * *